US005908058A

United States Patent [19]

Goglio

[11] Patent Number: 5,908,058

[45] Date of Patent: Jun. 1, 1999

[54] CONTAINER FOR GRANULAR PRODUCTS, PARTICULARLY COFFEE, AND RELATIVE SUPPORT FOR EMPTYING INTO A BAR COFFEE GRINDER

[76] Inventor: Luigi Goglio, Via Frua 11, 20146 Milan, Italy

[21] Appl. No.: 08/920,928

[22] Filed: Aug. 29, 1997

[30] Foreign Application Priority Data

Sep. 27, 1996 [IT] Italy ..... MI 96 A 001975

[51] Int. Cl.[6] ..... B65B 1/04

[52] U.S. Cl. ..... 141/364; 222/541.6; 229/122; 229/247

[58] Field of Search ..... 141/332, 364, 141/365, 366, 370, 375, 383, 384, 390; 220/359, 339, 661; 229/122, 247, 122.1; 222/541.6, 541.1, 541.9

[56] References Cited

U.S. PATENT DOCUMENTS

| | | | |
|---|---|---|---|
| 2,331,536 | 10/1943 | Cerf et al. | 229/55 |
| 2,331,966 | 10/1943 | Eisgrau | 229/55 |
| 3,184,117 | 5/1965 | Sanderson | 222/183 |
| 3,701,454 | 10/1972 | Thorp | 220/54 |
| 4,232,718 | 11/1980 | Wipperman | 141/358 |
| 4,491,161 | 1/1985 | Tamura et al. | 141/364 |
| 4,615,364 | 10/1986 | Kawata | 141/364 |
| 4,830,273 | 5/1989 | Kalberer et al. | 229/123.1 |
| 4,998,668 | 3/1991 | Rausing | 229/123 |
| 5,513,679 | 5/1996 | Yamada | 141/364 |
| 5,762,260 | 6/1998 | Goglio | 229/199 |

FOREIGN PATENT DOCUMENTS

| | | | |
|---|---|---|---|
| 522326 | 6/1992 | European Pat. Off. . | |
| 3438601 | 4/1986 | Germany | 383/10 |
| 2 049 625 | 12/1980 | United Kingdom . | |

*Primary Examiner*—Steven O. Douglas
*Attorney, Agent, or Firm*—Burns, Doane, Swecker & Mathis, L.L.P.

[57] ABSTRACT

A container of flexible material is described, for granular or powdery products, particularly coffee beans, having, at the corner of one of its walls (6), an opening (7) closed with a peel-off seal (8) provided with a pull tab (12), for easy emptying of its contents into a bar coffee grinder by placing the container (1) in a special support (20), mounted on the grinder and provided with a seat to receive the container, with a mobile partition such as to allow said pull tab (12) to emerge through a slit below, for easy pulling thereof, with opening of the peel-off seal (8).

14 Claims, 4 Drawing Sheets

CONTAINER FOR GRANULAR PRODUCTS, PARTICULARLY COFFEE, AND RELATIVE SUPPORT FOR EMPTYING INTO A BAR COFFEE GRINDER

BACKGROUND AND SUMMARY OF THE INVENTION

The present invention relates to a container for granular, powdery and similar products, in particular coffee beans, to be emptied into the grinder of a bar. The invention also concerns a support for such a container during emptying of its contents, which adapts to the normal bar coffee grinders currently in existence.

As is known, the various bars are normally supplied with coffee by the same company that has provided them with the equipment for preparation of the beverage. Besides the quality of the product, the cost of the coffee that is supplied takes into account the equipment supplied. The bar manager might therefore find it advantageous to purchase coffee at more competitive prices from other suppliers, such as supermarkets, for example, to the detriment of the quality of the product, for example re-using his own supplier's packaging.

An object of the invention is to eliminate or at least reduce this possibility, providing a coffee container that cannot be re-used after use, or that in any case discourages any re-use.

Another drawback of the containers currently in use, which are practically opened at the top and overturned, so that the mouth of the opening is placed in a special collection funnel provided above the grinder, is that during this operation, which, moreover, must be carried out with a certain care, the coffee-beans may be spilled.

Therefore, another object of the invention is to eliminate this drawback, providing a container that can easily be positioned, on a special support, for emptying into the grinder, without any danger of spilling part of its contents.

These objects are achieved with the container according to the invention which is described in detail below.

The support for such a container, for emptying thereof into a bar coffee grinder, is also described below.

Substantially, the container according to the invention, made by successive folding and welding of a multi-layered material, in particular a plastic laminate, with an inner layer that can be welded, for example polyethylene, is prism-shaped, in particular a parallelepiped, and has on one of its walls an opening, closed by a peel-off seal, through which the coffee can be emptied. This opening is advantageously made at a corner of the corresponding wall of the container, which is placed in an inclined position on a corresponding support, so as to allow complete emptying of the coffee beans.

The support has a seat able to receive the corresponding wall of the container with the opening, provided on the bottom with a mouth for emptying into the grinder, the opening of the container being placed to coincide with said mouth.

The seal that closes the opening provided in the container has a pull tab that comes to be positioned in a special slit in the support, following operation of a mobile plate, so as to allow said flap to be peeled easily.

BRIEF DESCRIPTION OF THE DRAWINGS

Further characteristics of the invention will be made clearer by the detailed description that follows, referring to a purely exemplary and therefore non-limiting embodiment thereof, illustrated in the appended drawings, in which.

DETAILED DESCRIPTION

Figure 1:
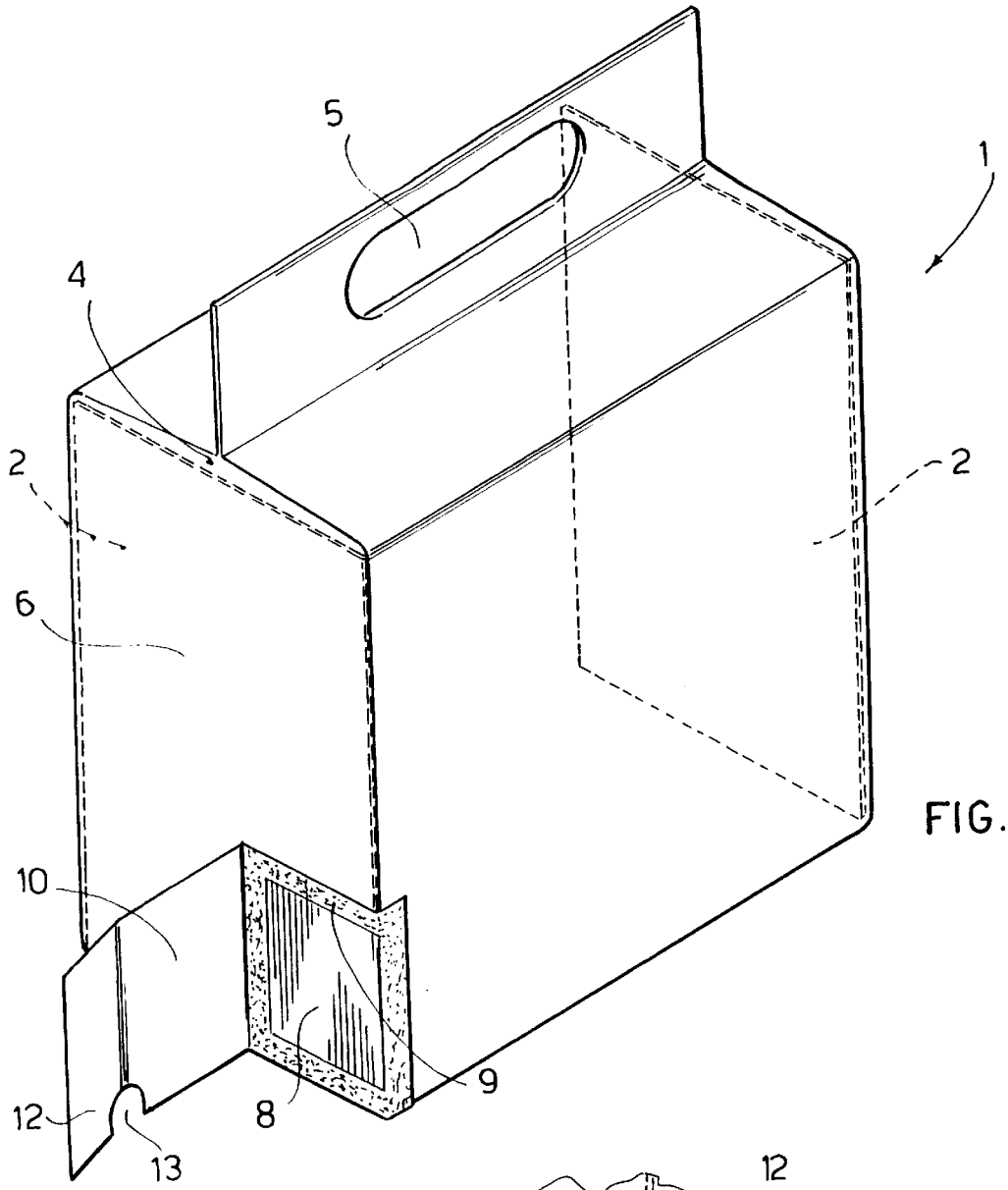
FIG. 1 is an axonometric view of a container according to the invention.

In FIG. 1 the container according to the invention has been indicated as a whole by reference numeral 1. It is for example made of flexible material, particularly multi-layered material, with an inner base of weldable material, such as polyethylene, and an outer base of paper. Of course the sheet material can have any arrangement of the layers, and can possibly also or only have the inner surface made of weldable material.

In particular such a container can be made according to the process described in European patent No. 522.326, having two stiffening plates at two opposite walls. In particular, in the example cited, these stiffening plates, indicated by reference numerals 2, are arranged inside two opposite side walls of the container 1, and are made of cardboard, for example.

Figure 2:
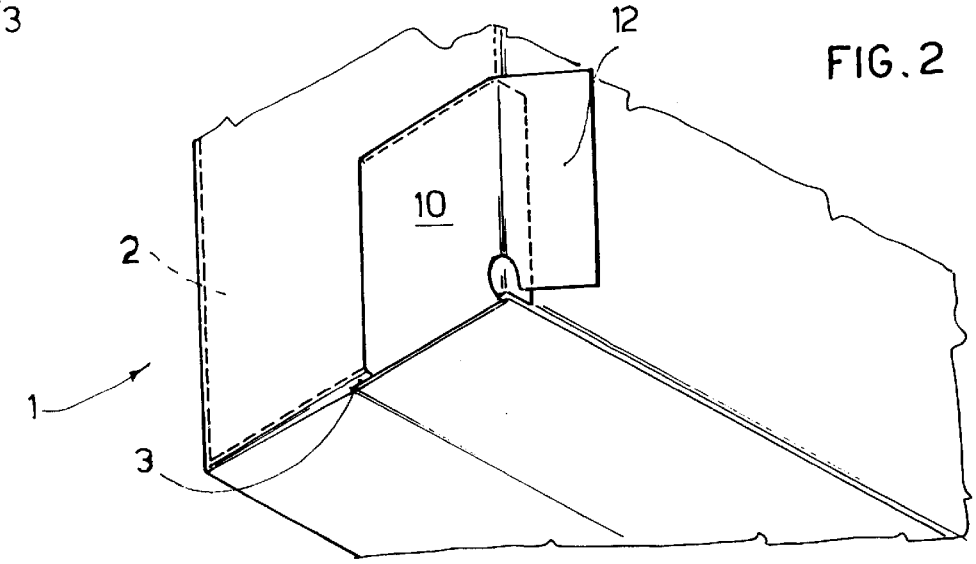
FIG. 2 is a view of part of the container in FIG. 1, showing the corner at which the opening with the peel-off seal is positioned for emptying of the product.

As can be seen in FIGS. 1 and 2, the container 1 has bellows-type folds 3, 4 at the base wall and at the upper wall, and at the latter it also has a gripping handle 5.

The container 1 for granular, powdery and similar products, particularly for coffee-beans may or may not be vacuum packed, and once closed the product is completely sealed.

Figure 6:
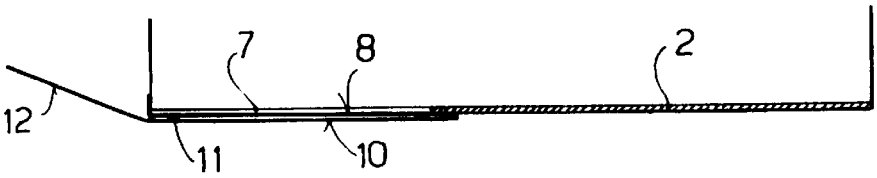
FIG. 6 is a schematic cross-section of the container in the emptying position, taken at the discharge opening of the product.

According to the invention, an opening 7 is made in a wall of the container 1, in particular at a corner of a side wall indicated by reference numeral 6 in the appended figures (see in particular the section in FIG. 6). Said opening is rectangular in shape and is sealed by means of a sheet of weldable, peel-off material 8, which is fixed by means of a closed weld line 9 which surrounds the perimeter of the opening 7. The peel-off sheet 8 has a portion 10 that protrudes inside the wall 6, beyond the weld line 9, said portion 10 being folded back onto the welded sheet 8, and possibly made to adhere thereto with a spot of adhesive or welding 11 (see in particular FIG. 6). The folded portion 10 of the sheet 8 also has a pull tab 12 protruding beyond the edge of the wall 6.

At the lower edge of the portion 10 and the pull tab 12 a cut 13 is also provided, which allows the sheet to be inserted into the bellows type fold 3 of the container, ensuring perfect closure.

Removal of the seal closing the opening 7, consisting of the welded sheet 8, can easily be effected by pulling outwards on the pull tab 12, with a movement parallel to the wall 6, so as to cause detachment of the glued or welded spot 11 if present, and peeling of the sheet 8.

According to the invention, this operation can be carried out, moreover in a simplified manner, whilst the container 1 is in the emptying position on a special support that can be adapted to a coffee grinder normally provided in bars, as will now be described.

Figure 3:
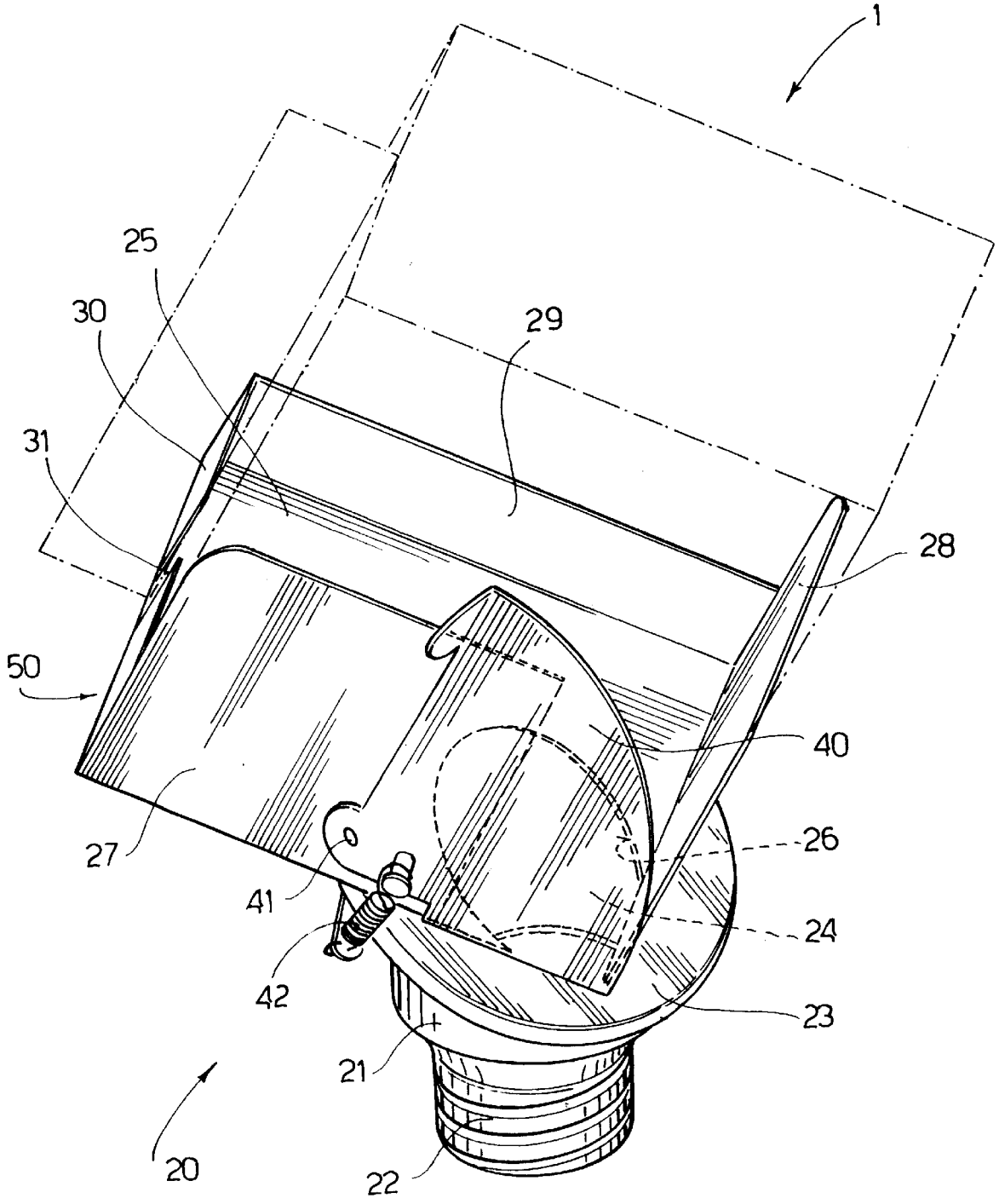
FIG. 3 is an axonometric view of the support for the container in FIG. 1, which can be mounted on a bar coffee grinder
Figure 5:
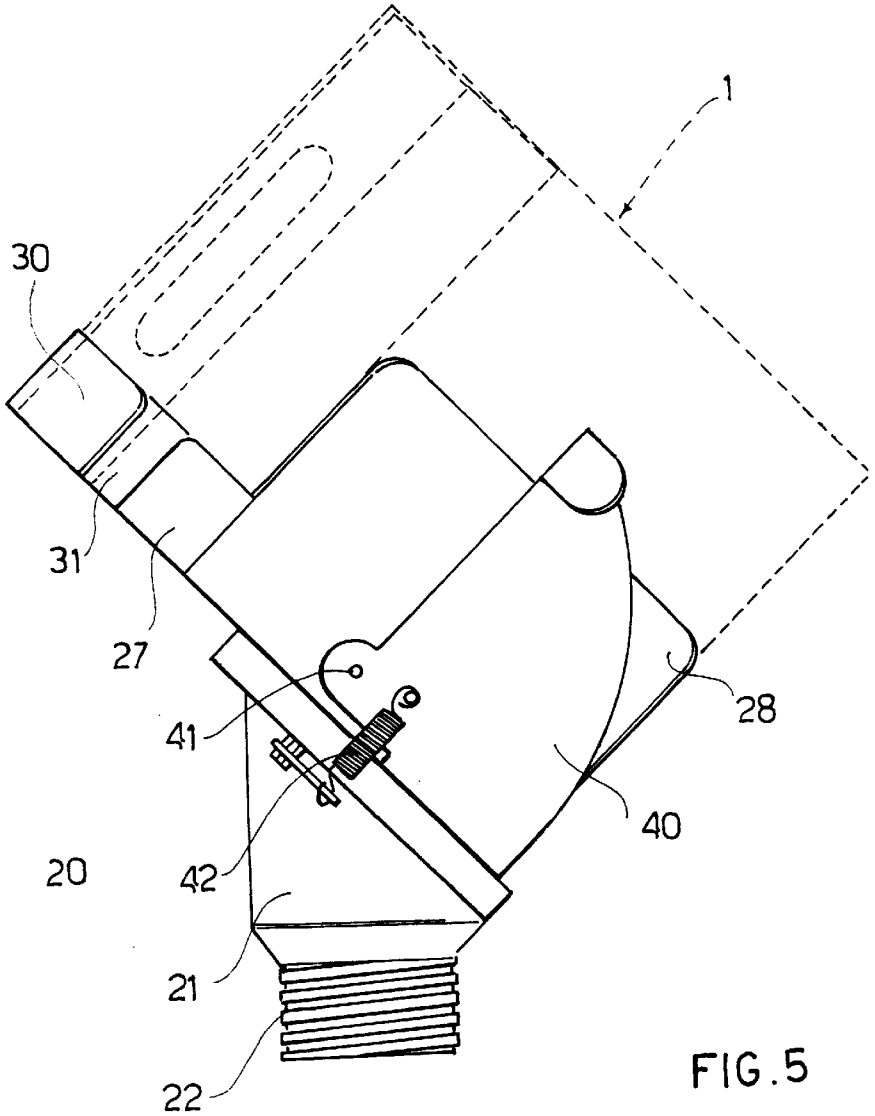
FIG. 5 is a side view of the support, taken in the direction of the arrow F in FIG. 4.
Figure 4:
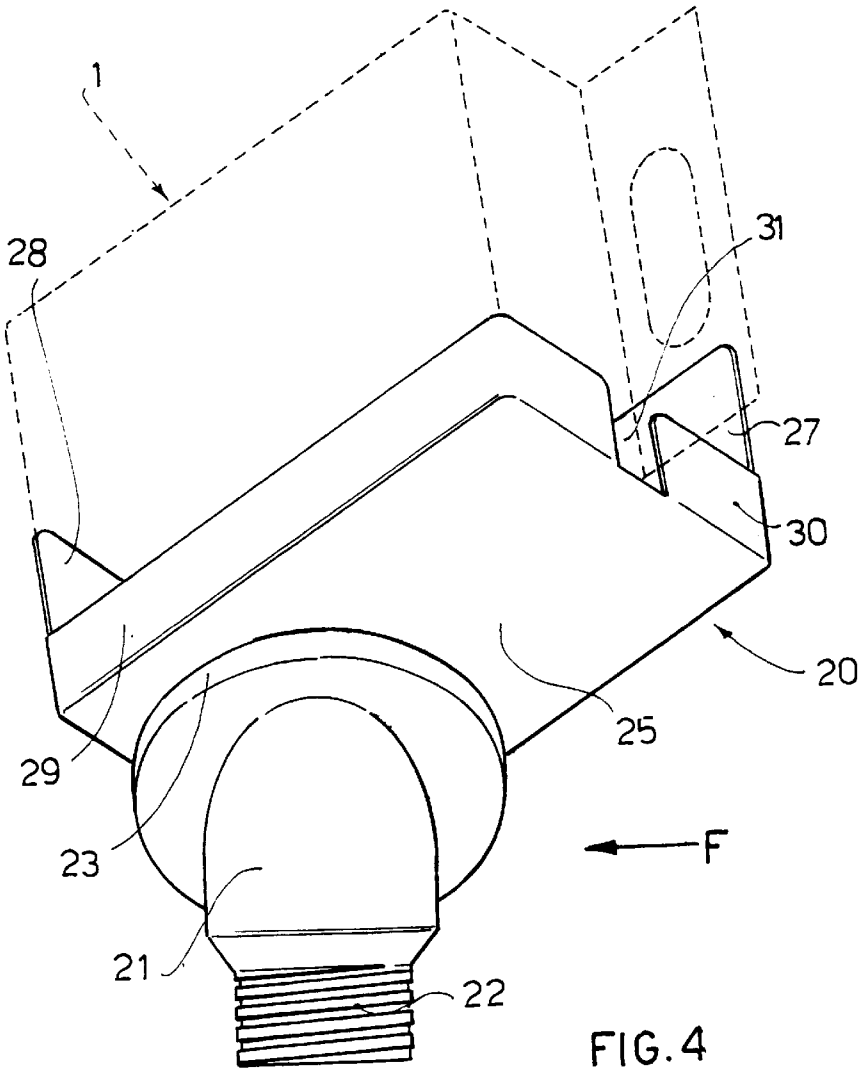
FIG. 4 is a view of the support in FIG. 3, taken from behind.

Such a support, identified as a whole by the reference numeral 20, is illustrated in FIGS. 3 to 5. It comprises a body 21, with a vertical axis, hollow on the inside, to allow the coffee to fall by gravity, and ends at the bottom in an outer thread 22 for screwing onto the body of the grinder, not shown in that it is per se known. It is clear, however, that fixing of the support 21 to the grinder can take place in any other manner, for example even by simple insertion of the tubular body 21 into a corresponding seat of the grinder.

In practice, the support 20 replaces the classical hopper placed on top of the grinder, able to receive coffee-beans.

The body 21 ends at the top in a flat flange 23, inclined for example by about 45° with respect to a horizontal plane, and having a hole 24, communicating with the inner cavity of the body 21.

The support proper for the container I is placed on the flat flange 23 and comprises a tray-shaped seat 50 having a bottom wall 25, parallel to the flat flange 23, and having a hole 26 that registers with the hole 24 in the flange 23.

Four side walls 27, 28, 29 and 30 rise perpendicularly from the bottom wall 25. The adjacent lower walls 27 and 28 are oriented so as to from a 45° angle with the vertical plane passing through their common corner, and have a greater height than the other two adjacent walls 29, 30, since they have to support the container 1 during emptying, as shown by the dashed line in FIGS. 3–5.

In the wall 30 of the tray a cut 31 is provided, to accommodate the gripping handle 5 of the container 1, when this is in position in the seat 50.

A door 40 is provided in the wall 27 and can be opened by rotating around a pivot 41, opposed by a spring 42, which tends to return it to the closed position. For the purposes of the present invention, the door 40 could open in any other way, for example by guillotine-type sliding.

Correct use of the support 20 with the relative container 1 according to the invention is as follows.

The container 1, in the sealed state, is positioned in the tray 50 of the support 20 with its opening disposed on the bottom 25 of the tray, so as to be positioned to coincide with the matching openings 26 and 24, in the bottom wall 25 of the tray and in the flange 23 of the hollow body 21 of the support 20, respectively.

Figure 7:
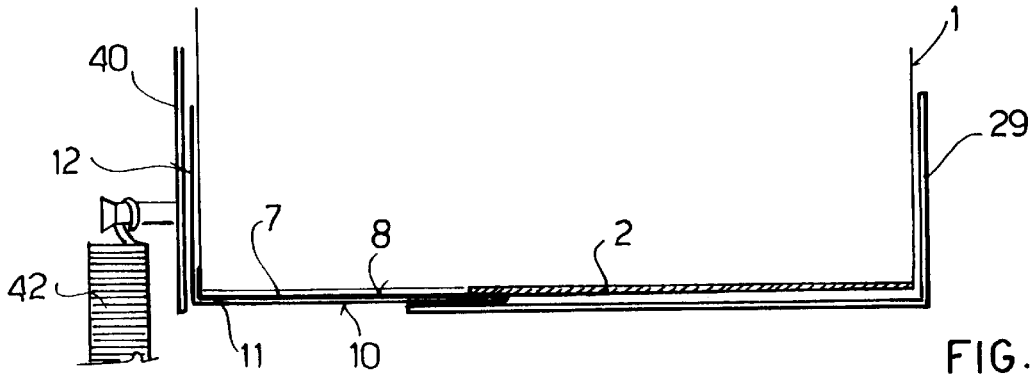
FIGS. 7 to 10 are schematic views, showing the part of the container, as in the cross-section in FIG. 6, housed inside the support, in successive stages of removal of the closing seal.

FIG. 7 schematically shows the container 1 inserted in the supporting tray, with the door 40 closed, and the tab 12 of the seal closing the opening 7 of the container, positioned between the latter and the inner surface of the door 40.

Figure 8:
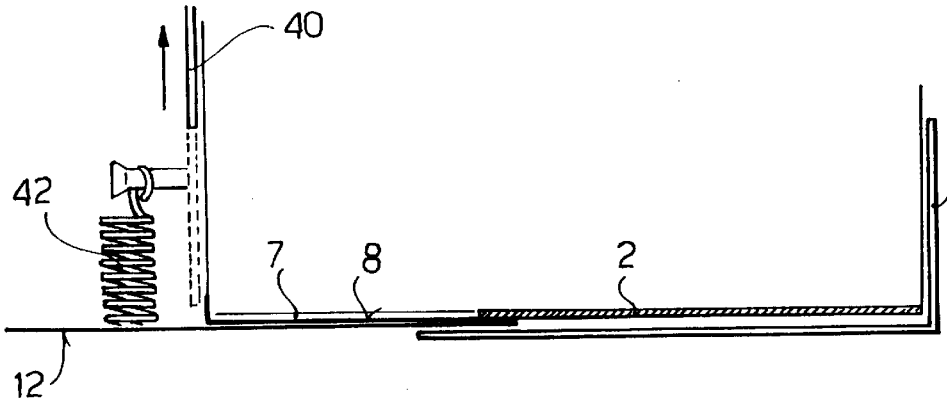

FIG. 8 shows the door 40 in the open or raised position and the tab 12 emerging towards the outside of the support tray 50 through an elastic reaction of its own material, as indicated by the arrows.

Figure 9:
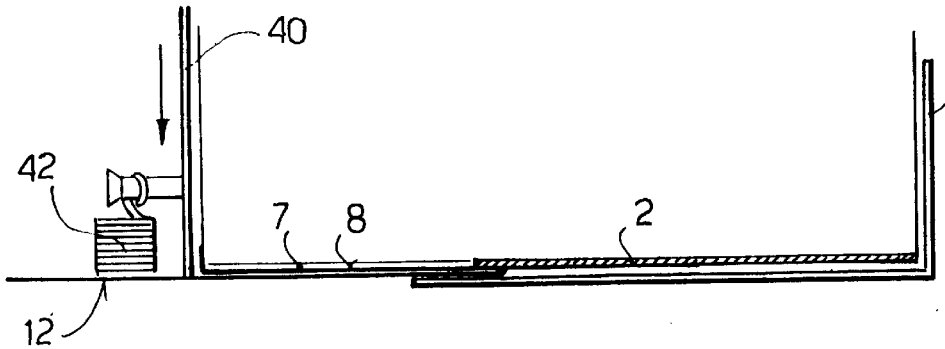

In FIG. 9, the door 40 has been closed and lowered again, as indicated by the arrow, so that the tab 12 emerges through a slit below the door 40 and is in an optimal position for pulling.

Figure 10:
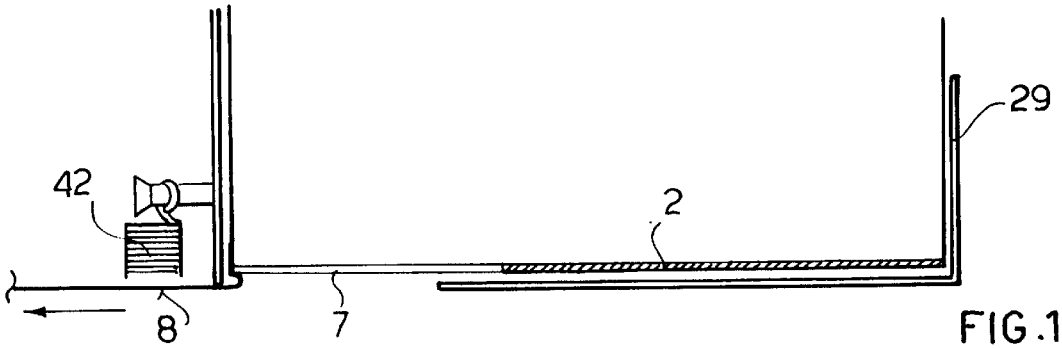

FIG. 10 shows the peel-off sheet 8 pulled in the direction of the arrow, with the opening 7 free to discharge the coffee granules into the grinder below through the hollow body 21 of the support 20.

In the appended figures manual pulling of the tab 12 of the seal closing the opening in the container has been shown, but it is obvious that automatic opening means could also be provided, such as adhesive means placed inside the door or mobile partition 40, which exert traction directly on the tab 12 during raising, causing peeling off of the sheet 8.

The particular inclination of the tray 50 of the support 20, both as regards its own bottom wall 25 and the two adjacent lower side walls 27 and 28, together with the corner position of the opening 7 made in the container 1, allows complete discharge of the product.

The hollow body 21 of the support 20 can advantageously be made of transparent plastic material, so as to give a visual indication of complete emptying of the container 1.

From what has been described the advantages of the invention are obvious, in that it perfectly solves the problems described with reference to the prior art.

I claim:

1. A device for containing coffee beans, comprising:

at least one sheet layer of flexible and weldable material folded to define a container having walls enclosing an interior for containing coffee beans, one of said walls having an opening at a corner of the container defined by three walls, and a peel-off seal releasably attached to said one wall to close the opening, said peel-off seal being a weldable sheet, welded along a closed line surrounding said opening, having a portion folded back onto and bonded to the sheet, and ending in a protruding pull tab.

2. A device according to claim 1, wherein said folded portion of the peel-off seal is bonded to the sheet by welding.

3. A device according to claim 1, wherein said peel-off sheet has at least one cut coinciding with said corner of said one wall and defining a flap to allow the flap of the sheet to be inserted in a bellows type fold provided in an adjacent wall of the container.

4. A device according to claim 1, further comprising a gripping handle formed on another of said walls and two reinforcing plates positioned on opposite side walls of the container.

5. A device according to claim 4, wherein said opening is made in one of the two side walls reinforced internally with the reinforcing plate.

6. A device according to claim 1, further comprising a support to allow emptying of the coffee beans into a bar coffee grinder, including a seat to hold the container, the seat having a bottom wall with an opening communicating with the grinder, and aligning with said opening of the container, and access means to allow manual opening of said peel-off seal.

7. A device according to claim 6, wherein said access means includes a movable partition on a first side wall of the seat, the container being positionable in the seat so that the wall having the opening is positioned with said protruding pull tab of the peel-off seal adjacent the movable partition, wherein a reciprocating movement of the movable partition causes said tab to protrude from said seat in a position parallel to said bottom wall of the support, through a slit defined beneath said movable partition.

8. A device according to claim 7, wherein said movable partition is mounted to the seat for movement by one of rotating and sliding, and further comprises elastic means to urge the movable partition to a closed position.

9. A device according to claim 6, wherein said bottom wall of the seat is inclined with respect to a horizontal plane.

10. A device according to claim 9, wherein the bottom wall is inclined with respect to a horizontal plane about 45°.

11. A device according to claim 9, wherein at the corner of the seat where said opening is provided in the bottom wall, said first side wall containing said movable partition, and a second side wall adjacent thereto and meeting at a corner form an angle of about 45° with a vertical plane passing through the corner.

12. A device according to claim 11, wherein said first and second side walls have a greater height than third and fourth side walls of the seat, and wherein the fourth wall has a cut out slot for receiving the gripping handle of the container.

13. A device according to claim 6, further comprising on the support a hollow body provided with means for mounting on a bar coffee grinder, said hollow body mounted to the bottom wall by a flat flange, and the flange having an opening, that registers with said opening in the bottom wall.

14. A device according to claim 1, wherein said folded portion of the peel-off seal is bonded to the sheet by at least one spot of glue.

* * * * *